US012089659B2

(12) United States Patent
Bemak

(10) Patent No.: US 12,089,659 B2
(45) Date of Patent: Sep. 17, 2024

(54) SOCIAL SMOKING DEVICE

(71) Applicant: SOCIALSMOKING.COM LLC, Marlboro, NJ (US)

(72) Inventor: Jesse Bemak, Long Branch, NJ (US)

(73) Assignee: SOCIALSMOKING.COM LLC, Marlboro, NJ (US)

( * ) Notice: Subject to any disclaimer, the term of this patent is extended or adjusted under 35 U.S.C. 154(b) by 180 days.

(21) Appl. No.: 16/920,541

(22) Filed: Jul. 3, 2020

(65) Prior Publication Data

US 2022/0000172 A1 Jan. 6, 2022

(51) Int. Cl.
*A24F 7/02* (2006.01)
*A24F 13/02* (2006.01)

(52) U.S. Cl.
CPC ..... *A24F 7/02* (2013.01); *A24F 13/02* (2013.01)

(58) Field of Classification Search
CPC .. A24F 13/14; A24F 13/00; A24F 3/00; A24F 13/02; A24F 13/06; A24F 40/20; A24F 1/00; A24F 1/28; A24F 13/04; A24F 13/12; A24F 13/16; A24F 40/10; A24F 40/40; A24F 40/42; A24F 40/51; A24F 40/53; A24F 40/95; A24F 7/02
See application file for complete search history.

(56) References Cited

U.S. PATENT DOCUMENTS

| | | | | |
|---|---|---|---|---|
| 2,005,233 | A * | 6/1935 | Martin | A24F 13/14 131/182 |
| 3,713,452 | A * | 1/1973 | D'Elia | A24F 13/06 131/215.2 |
| 2011/0226266 | A1* | 9/2011 | Tao | A24F 3/00 131/185 |
| 2012/0292207 | A1* | 11/2012 | Chau | B65D 85/12 206/265 |
| 2014/0020696 | A1* | 1/2014 | Liu | A61M 15/06 131/329 |
| 2014/0196716 | A1* | 7/2014 | Liu | A24F 40/46 128/202.21 |
| 2020/0015519 | A1* | 1/2020 | Conner | A24F 13/10 |

OTHER PUBLICATIONS

Merrimam-Webster, "profle", https://www.merriam-webster.com/dictionary/profile, Date accessed: Jan. 5, 2024 (Year: 2024).*

* cited by examiner

*Primary Examiner* — Michael H. Wilson
*Assistant Examiner* — Stephanie Lynn Moore
(74) *Attorney, Agent, or Firm* — Thomas D Foster; Jonathan Kidney

(57) ABSTRACT

A social smoking device allowing shared smoking without a shared mouthpiece, having a hollow crown piece having a tip side and smoking material side, with a at least one of a magnetic and metal crown coupler attached to the tip side; and a hollow tip piece having a mouth side and a crown side, with at least one of a metal and magnetic tip coupler attached to the crown side, wherein the crown and tip pieces are configured to removably join together via contact of the respective couplers to form a single hollow piece, the tip piece's mouth side is configured for contact with a user's mouth and the crown piece's smoking material side is configured for fitment of smoking material.

15 Claims, 4 Drawing Sheets

SOCIAL SMOKING DEVICE

FIELD

This invention relates to social smoking. In particular, this invention relates to sanitarily sharing cigarettes or the like using independent, interlocking smoking tips and crowns.

BACKGROUND

In social circles, it is not uncommon for various individuals to share a cigarette, cigar, or joint, etc. However, traditional sharing requires the next individual to place his/her mouth on the same end (foot) that the previous person just placed their mouth on. Of course, this exposes the following person to potential diseases or contaminants left on the "cigarette" from the previous person. To avoid this, conventional approaches are to "cut" the virgin cigarette into individual pieces to be shared, or have the cigarette held into a cigarette holder, wherein the cigarette is then removed (causing mangling and damage to the cigarette) and then inserted into the next holder (further causing damage), and so forth. Of course, these approaches are less than ideal and more trouble than they are worth, hence social smoking still heavily relies on the traditional unsafe approach.

Given the concern for potential disease transmission, what is needed is a device or method wherein subsequent participants can avoid contact with the previous person's "mouth" piece while still enjoying the shared cigarette or the like. Embodiments of such a device are detailed below.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, a social smoking device allowing shared smoking without a shared mouthpiece is provided, comprising: a hollow crown piece having a tip side and smoking material side, with at least one of a magnetic and metal crown coupler attached to the tip side; and a hollow tip piece having a mouth side and a crown side, with at least one of a metal and magnetic tip coupler attached to the crown side, wherein the crown and tip pieces are configured to removably join together via contact of the respective couplers to form a single hollow piece, the tip piece's mouth side is configured for contact with a user's mouth and the crown piece's smoking material side is configured for fitment of smoking material.

1. In another aspect of the disclosed embodiments, the above device is provided, wherein the couplers are annular shaped and disposed about a circumference of tip side and crown side of the pieces; and/or wherein the couplers are segmented arcs and disposed about a circumference of tip side and crown side of the pieces; and/or wherein the couplers are dot-shaped and disposed about a circumference of tip side and crown side of the pieces; and/or further comprising a filtering element disposed in and connecting the crown piece and the tip piece to each other; and/or wherein the tip piece's mouth side has a flattened profile; and/or further comprising creases disposed circumferentially about at least one of the crown piece and tip piece; and/or wherein the smoking material is a tobacco product in a shape of a cigarette; and/or wherein the smoking material a marijuana product in a shape of a cigarette; and/or further comprising a plurality of tip pieces; and/or a plurality of crown pieces; and/or wherein at least one of the crown piece and tip piece is made from glass, silicone, wood, metal, rubber, plastic, Pyrex, PVC, ceramic, or a precious metal; and/or wherein at least one of the crown piece and tip piece are substantially cylindrical; and/or wherein the tip piece is approximately 12 mm in diameter and approximately 30 mm in length.

In yet another aspect of the disclosed embodiments, a method for social smoking is provided, comprising: inserting a smoking material into a first end of a hollow crown piece, wherein an opposite end of the crown has at least one of a magnetic and metal crown coupler attached thereto; joining the opposite side of the crown piece to a first side of a hollow tip piece having at least one of a metal and magnetic tip coupler, wherein an opposite side of the tip piece is a mouth side; lighting the smoking material and inhaling; disjoining the crown piece from the tip piece and forwarding it to an other smoker; and joining the crown piece to a tip piece of the other smoker; and inhaling though the tip piece by the other smoker.

DETAILED DESCRIPTION

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

Figure 1A:
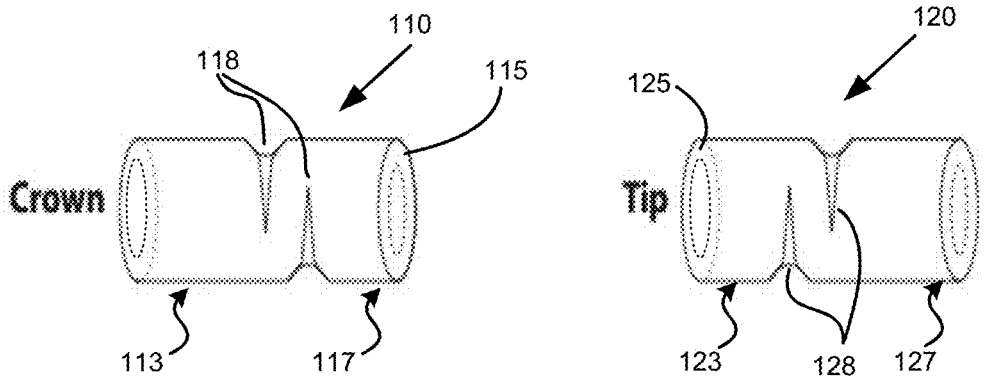
FIG. 1A is a side view illustration of an exemplary shareable mouthpiece system for social smoking.

FIG. 1A is a side view illustration 100 of an exemplary shareable mouthpiece system for social smoking. The exemplary system is comprised of two separable pieces that join together to form a single piece. The separable pieces are a hollow crown 110 and a hollow tip 120. Crown 110 has a "cigarette" side 113 and an opposite tip side 117. Tip 120 has a crown side 123 and a mouth side 127. Crown 110 operates to hold the smoked item (cigarette, cigar, marijuana, joint, etc.) which is inserted or held by cigarette side 113. Therefore, the size of the inside hollow of side 113 of crown 110 will be approximately that of the circumference of cigarette or sized appropriately for the to-be-smoked element.

Tip 120 functions similar to a cigarette holder mouthpiece (as in the conventional arts as seen in Raw or Roor products, for example), where mouth side 127 is for placement of the user's mouth. The size of the inside hollow of side 127 of the tip 120 can be any size suitable for smoking and may be oblong, rectangular or other-shaped, according to design preference. While the crown 110 and tip 120 appear in this Fig. as matching cylindrical devices, it is understood that this is not a requirement, as these elements need only provide a passage for both fitment of the "cigarette" and movement of the resulting vapors. However, for simplicity sake and aesthetic purposes, the crown and tip are shown in this Fig. as similarly shaped. It should also be noted that optional creases 118 in the crown 110 and optional creases 128 in the tip 120 are illustrated here, as these creases are sometimes found in commercial non-exemplary tips. Their purpose may be for filtering, aesthetics, easy gripping or for other uses, but are shown here as optional elements.

Using, for example, a conventional non-exemplary tip, it can be modified so a coupling element 125 is mounted to side 123 of tip 120. Similarly, a conventional non-exemplary tip can be modified to operate as an exemplary crown via the mounting of coupling element 115 to side 117 of crown 110. Therefore, the respective coupling elements 115, 125 can be coupled together to cause both crown 110 and tip 120 to form a single smoking piece.

In an exemplary embodiment, tip's coupling element 125 can be a magnetic element or the like, which is complemented with the crown's coupling element 115, which can be a metal element or the like. As is easily understood, by placing the "connecting" sides together, the crown 110 will connect and stay affixed to the tip 120, due to the magnetic forces between the coupling element. Alternatively, in other embodiments, the tip's coupling element 125 can be a metal element or the like and the crown's tip side 117 can contain the magnetic element or the like. Alternatively, in other embodiments, the polar opposite magnet type may be used for the respective connecting elements. That is, one side (tip or crown) may have a N-pole magnet, while the other side (crown or tip) may have a S-pole magnet. The coupling force of the magnet (magnet-to-metal, or magnet-to-magnet) can be gauged to be sufficient to allow the crown 110 and tip 120 to be joined together and stay together under normal handling, and also allow a user to disconnect the tip 120 from the crown 110 without requiring extraordinary force.

The magnet(s) or metal element can be affixed or held in place by adhesive, pressure or heat impressed, etc. and etc. into the respective sides. It is understood that the coupling elements in this or other embodiments should not significantly interfere with the passage of vapors through the exemplary device, or make it unduly difficult to inhale through the exemplary device. Therefore, their size, shape and arrangement about the respective tip and crown should be taken into consideration.

Figure 1B:
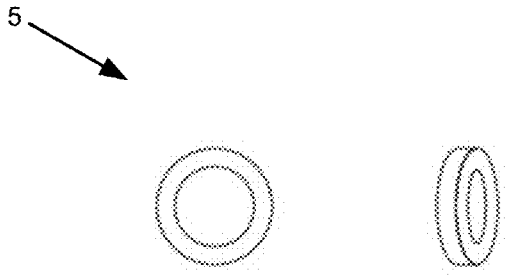
FIG. 1B is a view showing a front and perspective side view of one possible version of a coupling element.

FIG. 1B is a view showing a front and perspective side view of one possible version of a coupling element 5 which has an annular or ring-like shape. Two magnetically attracted "rings," when the respective crown and tip are joined, will be in proximity or in contact with each other to provide the desired connection forces. Having an annular magnet ensures there are no lesser forces at a different perimeter portions of the crown or tip, which would subject the connection to be vulnerable to a lateral disjoining force. This is believed to be an optimal arrangement for maximizing coupling forces around the contact surfaces between the crown and tip.

Figure 1C:
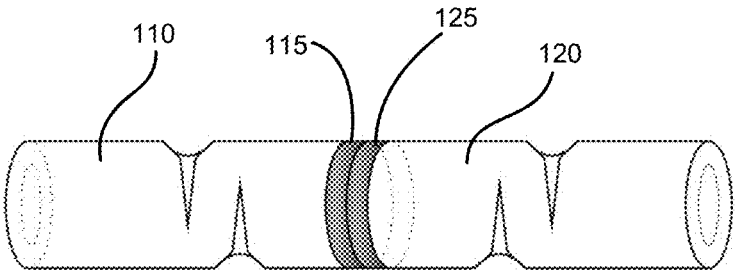
FIG. 1C is an illustration showing a joined exemplary crown and tip.

FIG. 1C is an illustration showing a joined crown 110 and tip 120, where crown coupler 115 is mated to tip coupler 125. In this embodiment, the couplers 115, 125 are shown as external to the body of the respective crown 110 and tip 120. That is, the couplers 115, 125 are not disposed inside the circumference of the respective crown 110 and tip 120. However, it is entirely possible and to have a different arrangement where the couplers are mounted or fixed "internal" to the circumference, this being a design preference.

Figure 2A:
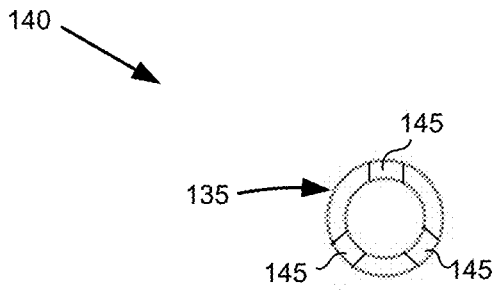
FIG. 2A is an illustration showing a coupler of segmented arcs around an outline of an exemplary tip or crown.
Figure 2B:
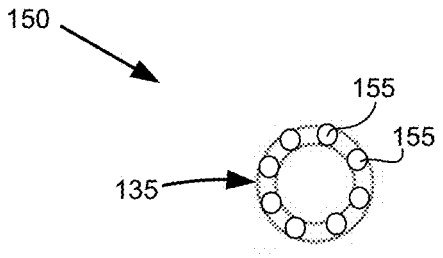
FIG. 2B is an illustration showing a ring of coupler "dots" around an outline of an exemplary tip or crown.

Also, it is possible to have a non-annular coupling element. For example, FIGS. 2A and 2B show examples of other coupler configurations. FIG. 2A's embodiment 140 shows segmented arcs 145 around an outline 135 of a tip or crown's hollow profile. FIG. 2B's embodiment 150 shows a ring of "dots" around an outline 135 of a tip or crown's hollow profile. Not shown, as another arrangement, for example, a side of the tip or crown could have a smaller diameter than the opposite crown or tip, to allow one side to fit "into" the other side. Appropriate arrangement of an outer/inner magnet/metal could be easily made. These examples show just some of the many other possibilities for arrangement of magnets/metal or couplers between the crown and tip and therefore, variations, modifications and changes to the arrangement, form, shape, type of couplers may be made without departing from the spirit and scope of this disclosure.

Figure 3A:
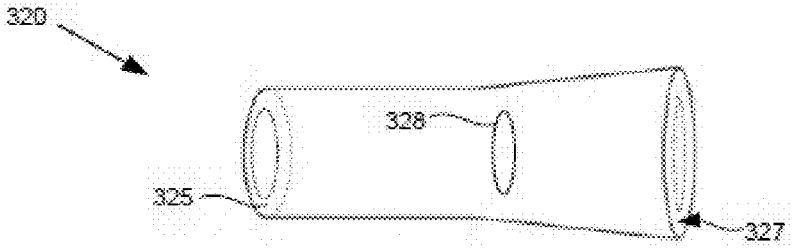
FIG. 3A is a top view of an exemplary tip with a flatted mouth side profile.
Figure 3B:
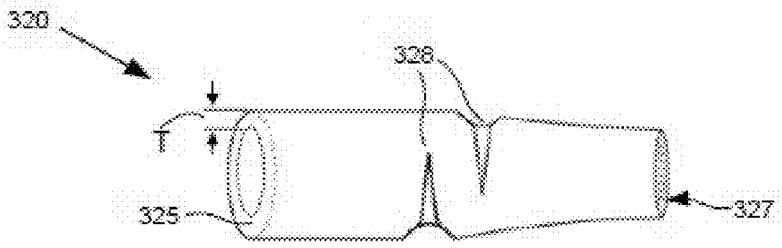
FIG. 3B is a side view of the exemplary tip of FIG. 3A, showing a narrowed profile of the mouth side.
Figure 3C:
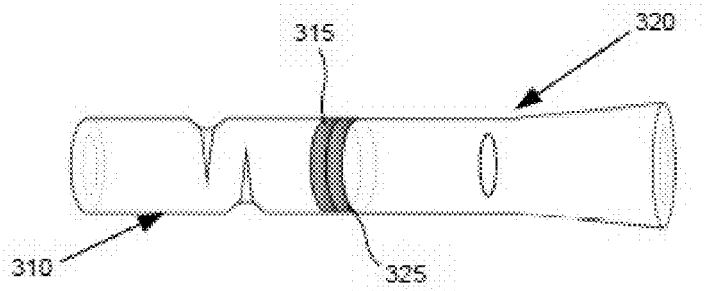
FIG. 3C is top view of the exemplary tip joined to an exemplary crown.

FIGS. 3A-C show alternate sizing and shapes for the tip. FIG. 3A is a top view of an exemplary tip 320, having a flatted profile-much akin to the tips of traditional use. The flattened "mouth-side" 327 profile enables easier gripping of tip by the mouth or teeth. Coupler 325 is on the opposite side of the mouth side 327. Optional creases 328 are shown here as being disposed on opposite sides of the tip 320's surface and in some embodiments serve to assist in facilitating a user's gripping of the tip 320 as well as assist in gripping a cigarette inside the tip's hollow. (If the device is made of glass, these creases (or partial circular indentations) reduce slippage. Based on the thickness T of the tip's hollow shell, and the depth of the creases 328, the creases 328 may protrude into the inner surface of the hollow tip 320 and thereby serve to narrow the inner hollow (obscured from view). For example, in FIG. 3B, it can be seen that the depth ("U" shape) of the creases 328 are equivalent to the thickness T, therefore it is apparent to one of ordinary skill the creases 328 are capable of "protruding" into the hollow of tip 320 thereby providing an internal crease-located narrowing. Similar opposing creases can also be seen in the crown 310. It is very apparent the creases 328 do not entirely circle the tip 320 or crown 310 and are partial in circumference, and not shown as grooves that encompass the entire circumference of the tip 320 or crown 310.

FIG. 3B is a side view of the exemplary tip 320, showing the narrowed profile of the mouth side 327 of the tip 320, and optiional creases 328 on the top and bottom surfaces. Coupler 325 is on the opposite side of the mouth side 327.

FIG. 3C is top view of the exemplary tip 320 oined to an exemplary crown 310, via couplers 315 and 325.

Figure 4:
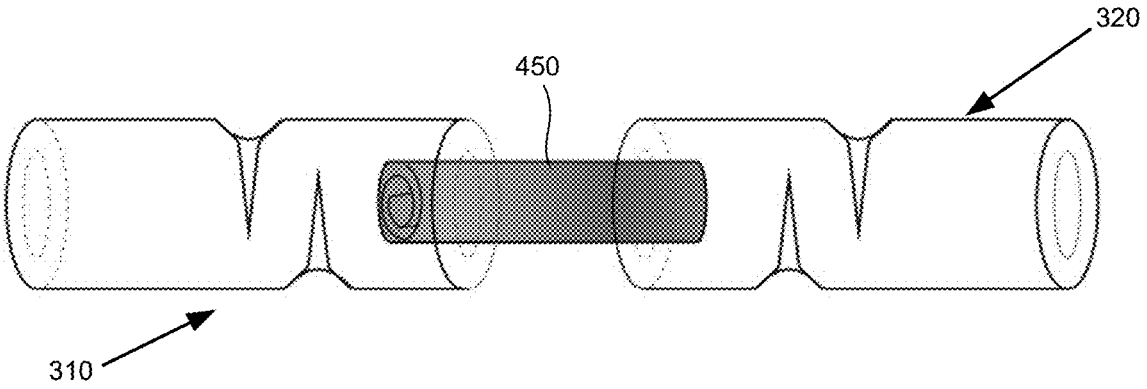
FIG. 4 is an illustration of a filter disposed between the crown and tip.

FIG. 4 is an illustration of a modification of the exemplary embodiments where a "filter" 450 is disposed between the tip 320 and crown 310. The filter 450 is of a diameter to fit within the hollows of the tip 320 and crown 310. In this example, the coupling between the pieces is accomplished through the filter 450, acting as a bridging member.

For the embodiments described herein, the bodies for the exemplary crown and tip may be manufactured from any desirable material, non-limiting examples being glass, silicone, wood, metal, rubber, plastic, Pyrex, PVC, ceramic, precious metals as well as composites of such. Also, the crown's material may be different than the tip's material. Further, the shapes shown for the exemplary embodiments are not the "only" shapes possible, as demonstrated by FIG. 3A. It is imagined that fanciful-shaped tips and/or crowns may be devised. However, regardless of the shape or material of the respective embodiments, they should have a means for coupling, such as shown herein via the use of magnet(s)/metal.

With respect to commonly used sizes, the non-exemplary tips are commonly available (Raw brand, for example), some of which can have a diameter of approximately 12 mm and lengths of approximately 30 mm. Of course, other dimensions are possible, according to design preference. For example, the diameter of the hollow in the crown and tip may be varied to accommodate cigars or conversely "slim" cigarettes, and so forth. Therefore, changes and modifications to the sizes or shapes of the crown and tip are understood to be within the knowledge of one of ordinary skill in the art and within the spirit and scope of this disclosure.

As can be appreciated, the separability of the crown from the tip enables the crown (containing the smoking material—lit or unlit) to be passed to other persons, and joining the crowned smoking material to the other person's tips for their smoking enjoyment. Therefore, a smoking material can be shared with multiple persons without actual mouth contact on the smoking material. Further, the crown can be used to "hold" the smoking material, without physical contact of the "cigarette."

The various aspects and embodiments disclosed herein are for purposes of illustration and are not intended to be limiting, with the true scope being indicated by the following claims.

What is claimed is:

1. A social smoking device allowing shared smoking without a shared mouthpiece, comprising two pieces:

a first hollow crown piece having a tip side and smoking material side, with at least one of a magnetic and metal crown coupler attached to the tip side, wherein a terminal end of the tip side has a first side profile encompassing an entirety of the tip side terminal end;

a second hollow tip piece having a mouth side and a crown side, with at least one of a metal and magnetic tip coupler attached to the crown side, wherein a terminal end of the crown side has a second side profile encompassing an entirety of the crown side terminal end, wherein the first and second side profiles are identical to each other and the terminal ends are flush to each other when joined; and opposing creases disposed partially circumferential about at least one of the first hollow crown piece and second hollow tip piece, the creases operating to narrow an interior of the at least one first hollow crown piece and second hollow tip piece, wherein the first hollow crown and second hollow tip pieces are configured to removably join together via magnetic contact of the respective couplers disposed on the tip side of the first hollow crown piece and the crown side of the second hollow tip piece, to form a single hollow smoking device when joined, wherein a terminal end of the second hollow tip piece's mouth side is configured for contact with a user's mouth and a terminal end of the first hollow crown piece's smoking material side is configured for fitment of a smoking material.

2. The social smoking device of claim 1, wherein the couplers are annular shaped and disposed about a circumference of the tip side and crown side of the first hollow crown piece and second hollow tip piece, respectively.

3. The social smoking device of claim 1, wherein the couplers are segmented arcs and disposed about a circumference of the tip side and crown side of the first hollow crown piece and second hollow tip piece, respectively.

4. The social smoking device of claim 1, wherein the couplers are dot-shaped and disposed about a circumference of the tip side and crown side of the first hollow crown piece and second hollow tip piece, respectively.

5. The social smoking device of claim 1, further comprising a filtering element disposed in and connecting the first hollow crown piece and the second hollow tip piece to each other.

6. The social smoking device of claim 1, wherein the first hollow tip piece's mouth side has a flattened profile.

7. The social smoking device of claim 1, wherein the smoking material is a tobacco product in a shape of a cigarette.

8. The social smoking device of claim 1, wherein the smoking material is a marijuana product in a shape of a cigarette.

9. The social smoking device of claim 1, further comprising a plurality of second hollow tip pieces being used by other users.

10. The social smoking device of claim 9, further comprising a plurality of first hollow crown pieces being shared by the other users.

11. The social smoking device of claim 1, wherein at least one of the first hollow crown piece and second hollow tip piece is made from glass, silicone, wood, metal, rubber, plastic, Pyrex, PVC, ceramic, or a precious metal.

12. The social smoking device of claim 1, wherein at least one of the first hollow crown piece and second hollow tip piece is cylindrical in form.

13. The social smoking device of claim 1, wherein the second hollow tip piece is 12 mm in diameter and 30 mm in length.

14. A method for social smoking, comprising:

inserting a smoking material into a first end of a hollow crown piece, wherein an opposite second end of the hollow crown piece has at least one of a magnetic and metal crown coupler attached thereto, and the opposite second end of the hollow crown piece has a first side profile;

joining the opposite second end of the hollow crown piece to a first end of a second hollow tip piece having at least one of a metal and magnetic tip coupler attached thereto, and first end of the second hollow tip piece has an entirety of the side profile identical to an entirety of the side profile of the opposite second end of the first hollow crown piece, wherein the first and second ends are flush to each other when joined and wherein an opposite second end of the hollow tip piece is a mouth side, wherein opposing creases are disposed partially circumferential about at least one of the first hollow crown piece and second hollow tip piece, the creases operating to narrow an interior of the at least one first hollow crown piece and second hollow tip piece;

lighting the smoking material and inhaling;

disjoining the hollow crown piece from the hollow tip piece and forwarding it to an other smoker;

joining the hollow crown piece to another hollow tip piece of the other smoker; and inhaling though the another hollow tip piece by the other smoker.

15. The social smoking device of claim 1, wherein an outer diameter of the terminal end of the tip side is the same as an outer diameter of the terminal end of the crown side.

* * * * *